United States Patent [19]

LaBoda et al.

[11] 4,326,453

[45] Apr. 27, 1982

[54] AIR TRANSFER DEVICE

[75] Inventors: John A. LaBoda, Fairview Park; Paul R. Fortlage, Sharon Center, both of Ohio

[73] Assignee: MTD Products Inc., Cleveland, Ohio

[21] Appl. No.: 200,420

[22] Filed: Oct. 24, 1980

[51] Int. Cl.[3] ..... F24F 13/08

[52] U.S. Cl. ..... 98/87; 98/33 R; 98/39

[58] Field of Search ..... 98/33 R, 36, 39, 41 R, 98/43 R, 43 A, 87, 116

[56] References Cited

U.S. PATENT DOCUMENTS

| | | | |
|---|---|---|---|
| 1,907,727 | 5/1933 | Breidery | 98/43 |
| 2,190,945 | 2/1940 | Guth | 98/33 R X |
| 2,420,123 | 5/1947 | Cooper | 98/39 |
| 2,566,630 | 9/1951 | Powers | 98/39 |
| 2,785,621 | 3/1957 | Heller | 98/36 |
| 3,396,651 | 8/1968 | Kamiya et al. | 98/33 R |

FOREIGN PATENT DOCUMENTS

| | | | |
|---|---|---|---|
| 1103433 | 5/1956 | Fed. Rep. of Germany | 98/33 R |
| 965461 | 7/1964 | United Kingdom | 98/36 |

*Primary Examiner*—Albert J. Makay
*Assistant Examiner*—Harold Joyce
*Attorney, Agent, or Firm*—Woodling, Krost & Rust

[57] ABSTRACT

A device for transferring air from the upper region of a room through an open doorway to the exterior of that room, such as to an adjacent room. The device includes an open-ended casing or conduit (15) mounted upright to a wall of the room just above a doorway (12), an electric fan (21) mounted in the casing or conduit (15) to draw air downwardly into and through the casing or conduit (15), and a hinged chute (16) positioned at the bottom of the casing or conduit (15) which, when declined downwardly, deflects such downwardly moving air out through the open doorway (12) to the exterior of the room.

1 Claim, 5 Drawing Figures

AIR TRANSFER DEVICE

FIELD TO WHICH INVENTION RELATES

The invention relates to a device for transferring air from one room or space to an adjoining room or space exterior of the room or space from which the transferred air is taken. It particularly relates to the transferring of air located in the upper region of a room, such as heated air that has moved upwardly into such upper region, to an area exterior of that room such as to an adjoining room.

Background Art Of The Invention

The related background art known to Applicants is the art of electric fans positioned in an opening cut or formed in the wall of a room for drawing air from that room and discharging the air outwardly from that room. However, such prior art does not suggest the present invention.

Statement Of The Invention

It is an object of the invention to transfer air from the upper region of a room through an open doorway leading from the room, and also to arrange that the door for the doorway may be moved to close the doorway.

Another object of the invention is to provide means for efficiently discharging air from a room to the exterior of that room without the need for puncturing or forming an opening in the wall of the room for discharging air therethrough.

Another object is the provision of an efficient and economical device for drawing air, particularly heated air, and transferring such air through an open doorway from the doorway without the need for providing an additional discharge duct from the room.

Other objects and advantages may be observed from the following description of the invention taken in conjunction with the drawings.

FIGURES OF THE DRAWINGS

DESCRIPTION OF THE PREFERRED FORM OF THE INVENTION

Figure 1:
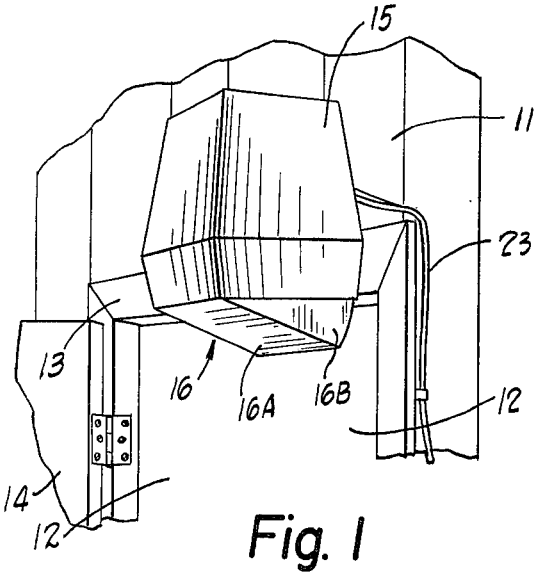
FIG. 1 is a perspective view of our air transfer device shown mounted above a doorway and with the door of the doorway standing open and with the chute drawn downwardly in operative position.

In a typical use of the invention our improved device has an open ended sheet metal casing 15 as shown mounted on a wall 11 of a room just above a doorway 12 leading to an adjacent room or to another area outside of that room. Usually a frame extends around the periphery of the doorway and such a frame 13 is illustrated in the drawings as extending across the top of the doorway 12 and along the upright sides of the doorway 12.

Figure 2:
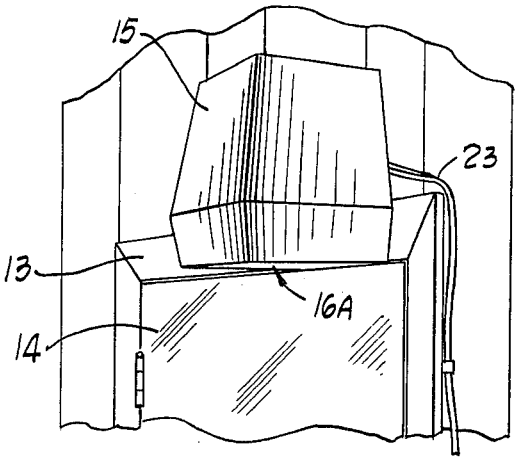
FIG. 2 is a perspective view of our air transfer device similar to the view of FIG. 1 but with the door of the doorway in a closed position and with the chute moved upwardly to closed inoperative position.
Figure 3:
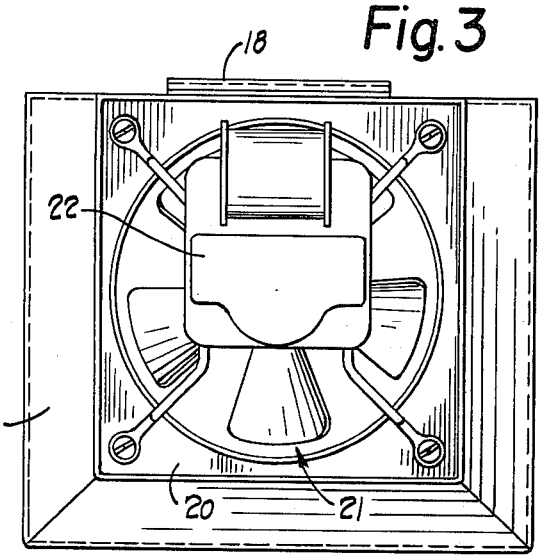
FIG. 3 is a plan view looking downwardly upon the top of our air transfer device.

A door 14 is shown hingedly connected to the frame 13 on one side of the doorway, which door 14 may be manually swung to an open position as illustrated in FIG. 1 and to a closed position as illustrated in FIG. 2.

The casing 15 of the device has four upright walls having a lowered tapered portion as illustrated. The upper end of the casing 15 is open so that air above the doorway in the room may freely enter into, and be drawn down in and through the casing 15.

At the lower end of the casing 15 there is a chute 16 hingedly connected to the casing 15 along the lower edge of the front wall of the casing 15 by a hinge 17. The chute 16 having the form illustrated in the drawing has a bottom wall 16A which is adapted to close off the bottom end of the casing 15 when the chute is swung upwardly on the hinge 17 to the closed position illustrated in FIG. 2. The chute 16 has side flange portions 16B which extend upwardly into the casing 15 adjacent the side inner walls thereof.

Figure 5:
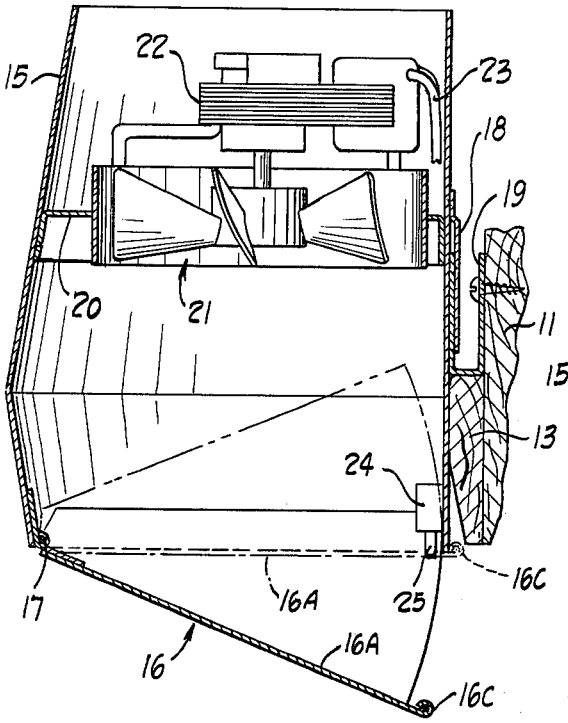
FIG. 5 is a longitudinal sectional view of our device taken through the line 5—5 and looking in the direction of the arrows 5—5, the chute being shown in full lines in its downward operative position.
Figure 4:
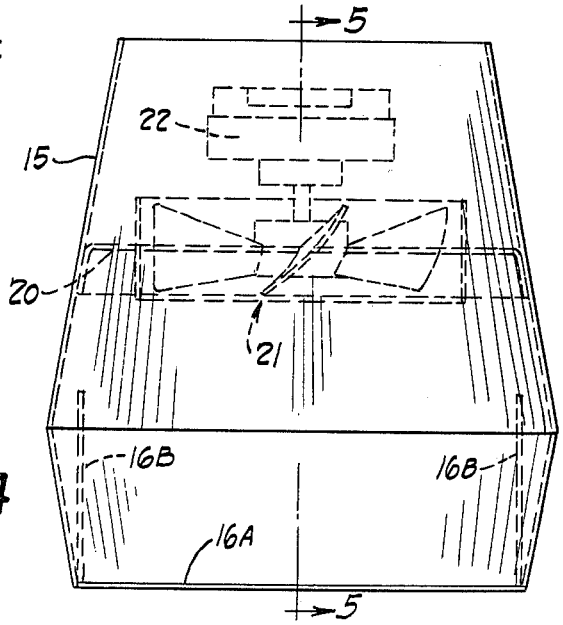
FIG. 4 is a longitudinal view looking at the front of our device, with the chute moved upwardly to closed inoperative position, and showing internal portions in broken lines.

Upon the chute 16 being swung downwardly to its lowered position shown in FIGS. 1 and 5, the bottom wall 16A is inclined as illustrated. The side flange walls 16B interengage with the bottom edge portions turned slightly inward to limit the downward movement of the chute 16 to the open position illustrated in FIGS. 1 and 5 wherein the bottom wall 16A is inclined as shown. A handle portion 16C is formed on the rearward edge of bottom wall 16A for easy grasping of the chute to move the same. Friction between the inner wall of the housing 15 and flange side portions 16B of chute 16 maintain the chute in desired position such as raised position shown in FIG. 2.

A metal bracket 18 is securely mounted, by welding or otherwise, to the rear wall of the casing 15. As seen in FIG. 5, this bracket 18 provides a narrow open space between the bracket 18 and rear wall of the casing. The bracket 18 is hooked downwardly as illustrated.

A metal supporting member 19 is secured, such as by screws, to wall 11 of the room just above the upper door frame 13. This supporting member 19 is of U-shape cross-section with the mouth of the U directed upwardly as shown. The bracket 18 is readily slid downwardly to fit into the supporting member 19 to the nested position shown in FIG. 5. Thus the device is supported in position above the doorway by its engagement with the upper surface of door frame 13 and by the inter-engagement of bracket 18 and supporting member 19.

Within the casing 15 a supporting metal partition 20 extends laterally of the casing 15 a distance below the upper open end of the casing. The metal partition 20 is secured, such as by welding, to the inner walls of the casing 15. The partition 20 has an open space provided therein which affords communication for air moving downwardly from the upper portion of the casing to the lower portion.

An electric fan structure of usual and well known form, denoted generally by the reference character 21, is mounted on the partition 20 in axial alignment with the open space in the partition. A motor 22 of the fan structure 21 extends upwardly above the partition 20. The fan blades are oriented so that upon the fan motor 22 being electrically energized the fan blades blow air downwardly through the opening in partition 20 so as to draw air from the upper region of the room downwardly into the casing 15 and hence through the casing and out of the bottom end of the casing when the chute is in its downward position shown in FIGS. 1 and 5.

An electric circuit comprising wires 23 is connected to the motor 22 for energizing the same. The wires 23 are adapted to extend downwardly along the sides of frame 13 and suitably connected to an electrical outlet or terminal in the wall, the outlet or terminal being electrically connected to a source of electrical energy.

Connected in series with the wires 23 is an electrical switch 24 and arranged to control the flow of current through the wires 23 to the motor 22. This switch 24 is mounted in the casing 15 near the bottom of the back wall of the casing. The switch 24 has an actuating button 25 biased to protrude downwardly therefrom and so positioned as to be engaged by the bottom wall 16A of chute 16 when the chute is moved to its upward position closing the bottom of the housing, such as to the position shown in FIG. 2. The pressing upward on button 25 by the chute opens the switch 24 so as to discontinue energization of motor 22. This assures that when the chute has been moved upwardly to close off the bottom end of the casing, the fan is no longer operating to blow air.

By the structure and arrangement described, the casing 15 may be mounted above a doorway of a room. Upon the door 14 being open and the chute 16 moved to its lower position of FIG. 1, air, such as heated air in the upper portion of the room, may be transferred by energization of the fan from such upper region of the room shown through the casing and then deflected by chute 16 through the open doorway into the adjacent area, such as into the next room. This aids in providing heated air into the next room which might be deficient in such heated air.

Upon it being desired to swing the door 14 from its open position of FIG. 1 to the closed position of FIG. 2, the chute 16 is first moved upward to its closed position and thus interference between door 14 and chute 16 is avoided. The closing of the chute 16 to its position of FIG. 2 terminates operation of the fan by reason of the described actuation of switch 24. Upon it being desired to again transfer air from the upper region of the room, the door 14 is first swung to its open position and the chute 16 swung down to its lowered position, which releases the switch 24 and allows the fan to again operate upon energization of the motor.

Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and the scope of the invention as hereinafter claimed.

What is claimed is:

1. A device for transferring air from the upper portion of a room to an exterior space through an open doorway leading from the said room to said exterior space, the room having a wall portion above the said open doorway, comprising in combination a conduit adapted to be mounted in said room to the said wall portion above the said open doorway, said conduit having an upwardly directed open upper end through which air may flow downwardly and enter the conduit from the upper portion of the room and an open bottom end through which air in the conduit may escape, said open upper end and said open bottom end being in axial vertical alignment, an electric fan mounted in said conduit in position to draw air from siad upper portion of the room into the conduit through said open upper end thereof, the fan rotating on an axis parallel to said vertical alignment of said upper and lower open ends, said fan being adapted to be connected by an electrical circuit to a source of electrical energy, and a chute disposed at the open bottom end of the conduit and hingedly connected thereto along a pivot line on a side of the conduit farthest from said wall portion above said doorway, said chute upon being hingedly swung upwardly toward said conduit being disposed laterally across said open bottom end and clearing the doorway to permit the movement of a door to and from the doorway, said chute upon being hingedly swung downwardly away from said conduit at an acute angle to said conduit to be inclined downwardly and toward said open doorway being disposed to divert air moving downwardly through the conduit and out of the open bottom end thereof to flow through the open doorway into said exterior space.

* * * * *